United States Patent [19]

Wiedeck

[11] Patent Number: 5,063,630

[45] Date of Patent: Nov. 12, 1991

[54] MOVABLE BRIDGE AND SYSTEM FOR LAYING THE BRIDGE

[75] Inventor: Hans-Norbert Wiedeck, Mülheim/Ruhr, Fed. Rep. of Germany

[73] Assignee: Krupp Industrietechnik GmbH, Duisburg, Fed. Rep. of Germany

[21] Appl. No.: 505,690

[22] Filed: Apr. 6, 1990

[30] Foreign Application Priority Data

Apr. 7, 1989 [DE] Fed. Rep. of Germany ..... 3911266

[51] Int. Cl.[5] ..... E01D 15/12

[52] U.S. Cl. ..... 14/2.4

[58] Field of Search ..... 14/2.4, 1, 2

[56] References Cited

U.S. PATENT DOCUMENTS

| | | | |
|---|---|---|---|
| 4,413,369 | 11/1983 | Terrien et al. | 14/2.4 X |
| 4,493,122 | 1/1985 | Echtler et al. | 14/2.4 |
| 4,521,932 | 6/1985 | Parramore | 14/2.4 |
| 4,534,079 | 8/1985 | Tucker | 14/2.4 X |
| 4,972,539 | 11/1990 | Reiter | 14/2.4 |

FOREIGN PATENT DOCUMENTS

| | | | |
|---|---|---|---|
| 0093873 | 11/1983 | European Pat. Off. . | |
| 1945676 | 3/1971 | Fed. Rep. of Germany . | |
| 1816876 | 5/1971 | Fed. Rep. of Germany . | |
| 3320633 | 12/1984 | Fed. Rep. of Germany . | |
| 0837994 | 6/1981 | U.S.S.R. | 14/2.4 |

OTHER PUBLICATIONS

Federal Republic of Germany Search Report for Application No. P39 11 266.7, dated Aug. 31st, 1989.

*Primary Examiner*—William P. Neuder

*Attorney, Agent, or Firm*—Spencer & Frank

[57] ABSTRACT

A movable bridge has a bridge section having an upper face with a roadway thereon and a hinge having a horizontal axis perpendicular to the longitudinal direction of the bridge. There is a lower chord fixed to and extending along the length of the bridge section. The bridge section includes a roadway section disposed in an end region of the bridge section and pivotally attached at the hinge.

13 Claims, 6 Drawing Sheets

MOVABLE BRIDGE AND SYSTEM FOR LAYING THE BRIDGE

CROSS REFERENCE TO RELATED APPLICATION

This application claims the priority of Federal Republic of Germany Application No. P 39 11 266.7 filed Apr. 7th, 1989, which is incorporated herein by reference.

BACKGROUND OF THE INVENTION

1. Field Of The Invention

The present invention relates to a movable bridge which includes at least one bridge section equipped with a roadway on its upper face, and to a system for laying a bridge.

2. Background Art

Such bridges, which are usually employed as temporary bridges, are generally pushed across an obstacle (e.g., a river or ditch) and deposited with the aid of a vehicle equipped with a laying device. In most cases, the bridges are also transported on the same vehicle. With respect to their longitudinal direction, such bridges may have a one-piece construction, i.e., be composed of only a single bridge section or component. Alternatively, such mobile bridges may be a combination of several individual bridge sections. All bridges have in common that a ramp is formed at both ends. Especially in connection with shorter bridges of this type, particular difficulties arise owing to the fact that only a certain bridge length can be loaded onto a vehicle and that is then what is available at the intended location. Often it is not predictable which bridge length will be required in each particular case. For example, European Patent Application No. EP 0,093,873, a counterpart to U.S. Pat. No. 4,493,122, discloses a bridge composed of two ramp sections which are transported on a motor vehicle. Such a bridge has a defined length, which is generally 26 meters. On the other hand, DE-OS 3,320,633, Federal Republic of Germany Offenlegungsschrift (laid-open unexamined application), discloses a bridge laying device in which two 12-meter short bridges are transported on a vehicle and that can be individually laid by the vehicle. It is not possible to combine the two short bridges into one bridge of twice the length.

SUMMARY OF THE INVENTION

It is an object of the present invention to provide a movable bridge of the above-discussed type in which the bridge sections, particularly those transported on a vehicle, allow for the construction of bridges of different lengths.

This is accomplished by the present invention in that the inventive bridge section includes, over its entire length, at least one fixed lower chord and is provided with at least one hinge having a horizontal axis extending perpendicularly to the longitudinal direction of the bridge. A roadway section or end region of the bridge section pivots about this hinge. The roadway, and the end region or roadway section, which takes up only part of the length of the bridge section, may be made of one piece or, as is generally provided in temporary bridges, as two parallel tracks.

The invention permits a multitude of different configurations for the bridge sections and the connected formation of a number of bridge sections of different length.

According to one advantageous feature of the invention rails are disposed at the lower chord so that the bridge section can be moved on a laying device. Instead of attaching rails to the lower chord, the lower chord itself can be constructed from rails.

Moreover, a particularly advantageous structure for the novel bridge sections results from the hinge being disposed in the region of the upper face of the roadway and the roadway section being provided with at least one support. The support may simultaneously form the side walls of the roadway section so that a supportive U-shaped configuration results for the roadway cross section.

The articulated roadway section is preferably fixable in at least its end positions so as to stiffen the bridge under load. Any possibly occurring shear stresses can easily be distributed over the longitudinal direction of the bridge given that the fixing members in the lower position of the roadway section are formed by engaging teeth.

Suitable adjustment devices for adjustably pivoting the roadway section may be provided in the form of linear motors, preferably hydraulic cylinders, which are also suitable, in particular, for absorbing greater loads.

An embodiment in which the bridge section has two ramp-shaped regions, of which at least one is configured as a pivotal roadway section, is particularly suitable for the formation of short bridges. This results in particular advantages if two such bridge sections can be loaded on top of one another on a transporting vehicle and can be coupled together at their upwardly pivoted roadway sections. The loaded bridge sections are thus able to form two short bridges or can be combined to build a bridge of twice the length.

BRIEF DESCRIPTION OF THE DRAWINGS

The drawing figures are schematic representations of several embodiments of the invention in which.

DETAILED DESCRIPTION OF THE PREFERRED EMBODIMENTS

Figure 1:
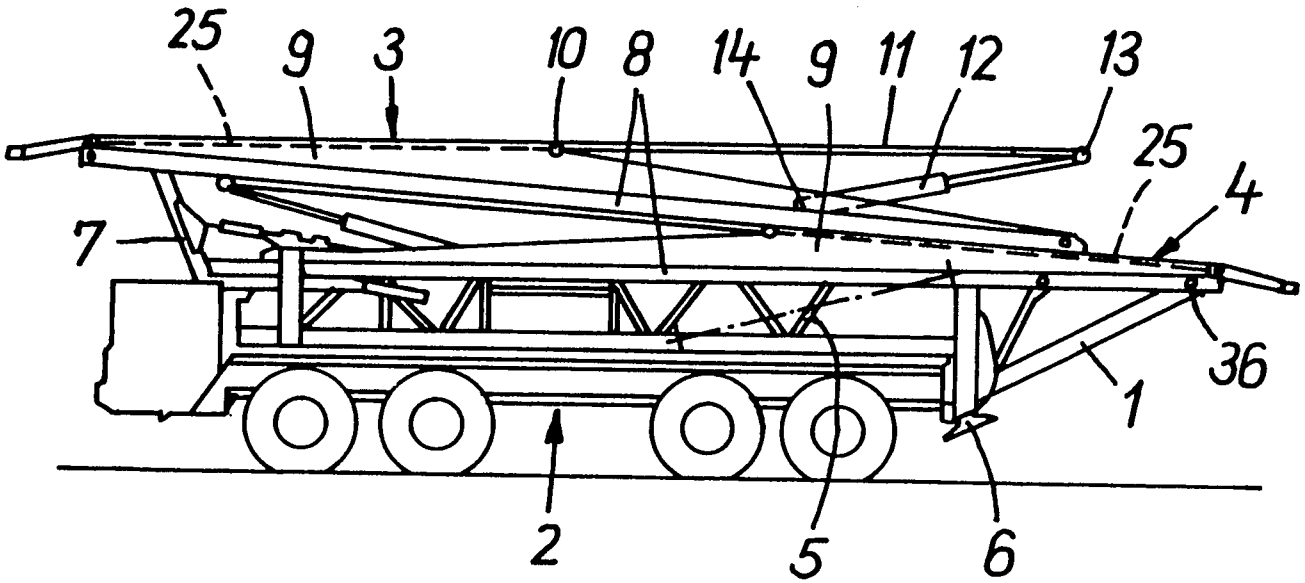
FIGS. 1 to 3 are side views of a bridge laying device of the type disclosed in EP 0,093,873, a counterpart to U.S. Pat. No. 4,493,122, as described above, mounting bridge components according to the invention, in three different positions of the loaded bridge components.
Figure 2:
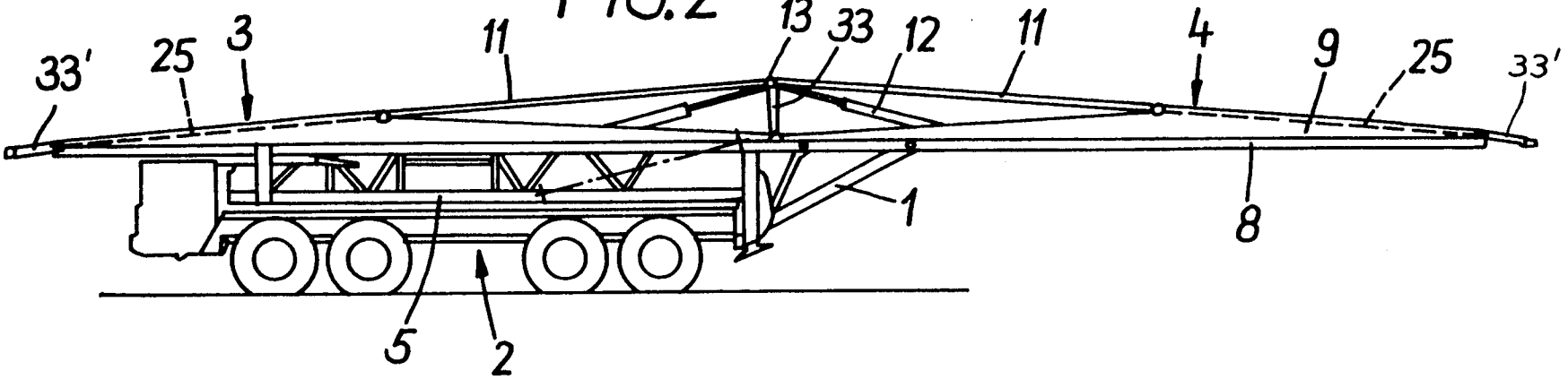
Figure 3:
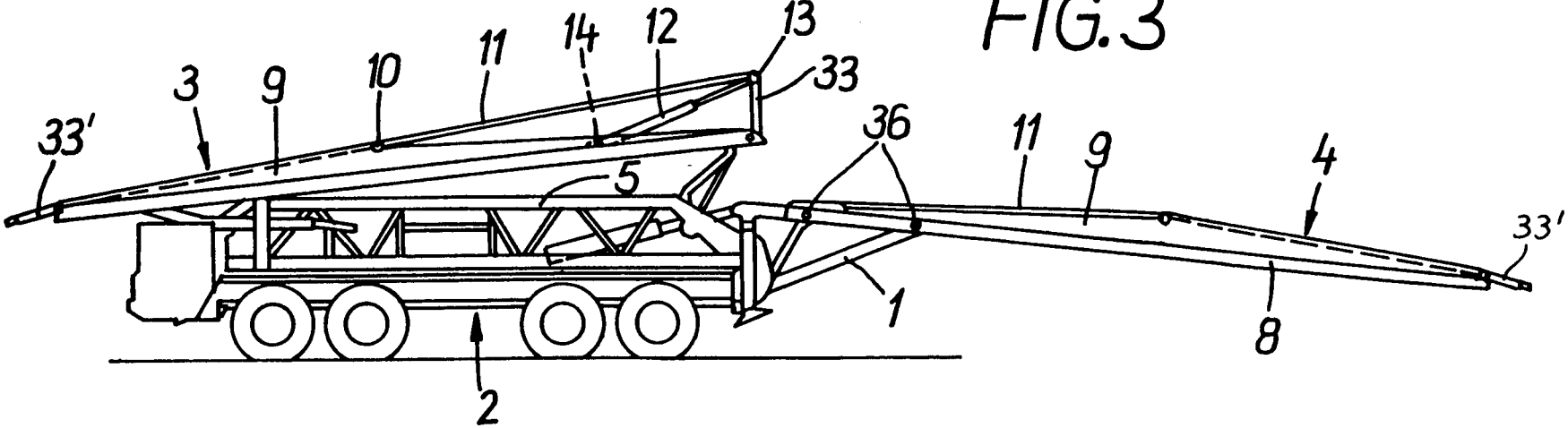

The mobile bridge embodiments of the present invention can be used with a bridge laying vehicle 2 as shown in FIGS. 1–3.

As can be seen in FIG. 1, a vehicle 2 whose rear end is equipped with a laying device 1 carries two identically configured bridge elements or sections 3 and 4 which lie on top of one another on a frame assembly 5 and which can be pushed out toward the rear end of vehicle 2. Frame assembly 5 also carries laying device 1 and is provided at its free end with downwardly extendable ground support elements 6. A lever 7 articulated to the front end of frame assembly 5 also assists in the laying of the bridge components.

Figure 4:
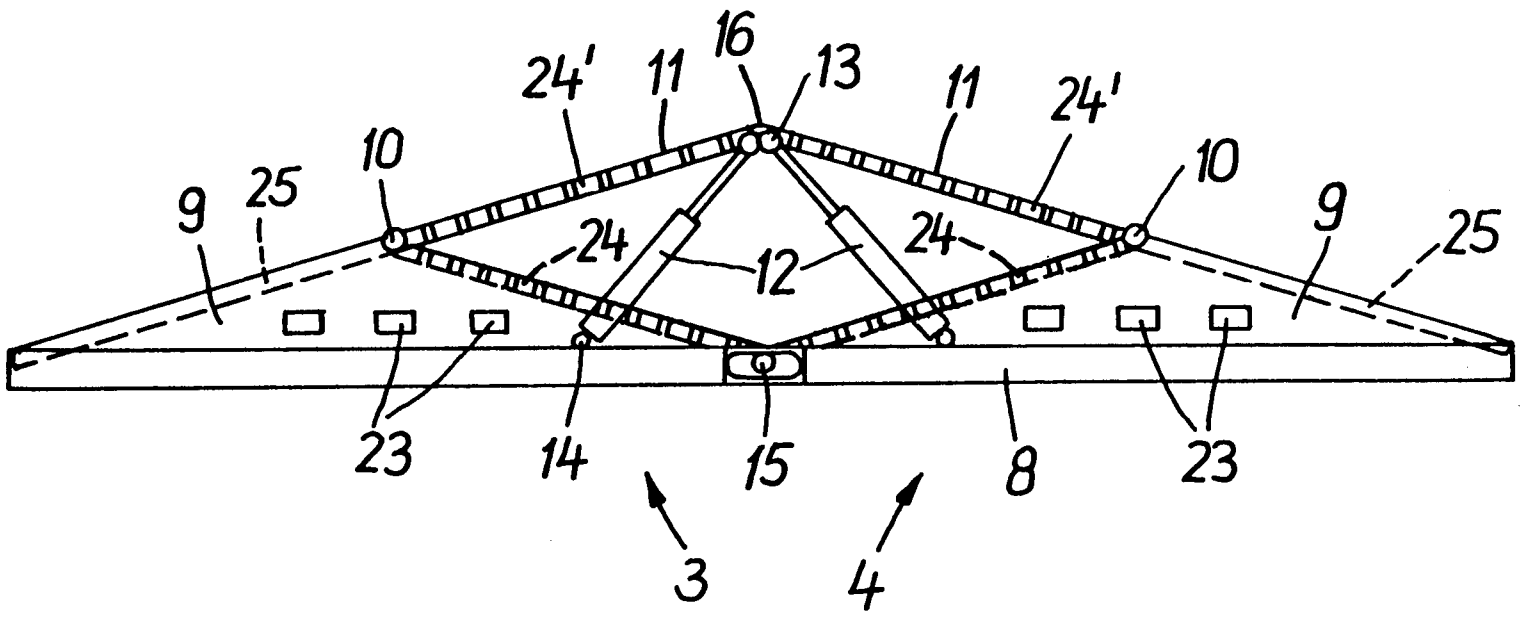
FIG. 4 is a side view of a bridge of a further embodiment of the present invention composed of two bridge sections.
Figure 6:
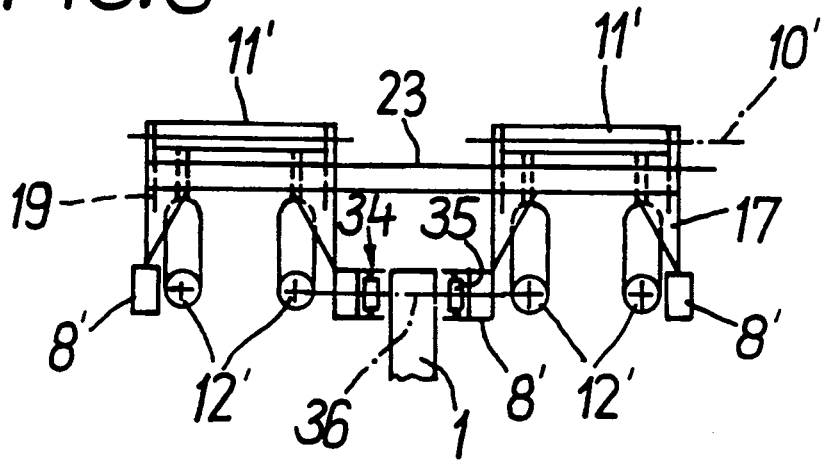
FIG. 6 is a sectional view seen along section line VI—VI of FIG. 7.

Bridge sections 3 and 4 each include, in a known manner, two parallel extending tracks which are connected with one another by way of center or transverse struts 23 (see FIGS. 4 and 6). Each track includes two lower chords 8 which extend over their entire length and which, in the embodiment of the invention as shown in FIG. 4, are each followed toward the top by a vertical, triangular side wall 9. Furthermore, in the mobile bridge according to a first embodiment of the invention, bottom chords 8 and triangular side walls 9 jointly define an upwardly oriented triangle. In the region of the vertex of this upwardly oriented triangle, a hinge 10 is disposed which has a horizontal axis extending perpendicularly to the longitudinal direction of the bridge. Each bridge section 3 and 4 includes a roadway section or end region 11 which is pivotable about hinge 10 and which is likewise composed of two parallel tracks. Between the axis of hinge 10 and the ends of bridge sections 3 and 4 facing the pivotal end of roadway section 11, there is fixedly provided, separately for each track, a sloped roadway section 25.

Each lower chord 8 of the embodiment of FIG. 4 of the invention has an associated hydraulic cylinder 12 whose extendable end is articulated at a point 13 to the end of roadway section 11 and at its other end at a point 14 in the region of lower chord 8.

When bridge sections 3 and 4 are loaded, the hydraulic cylinders 12 are extended to the point that fixed roadway section 25 lies in one plane with the respective pivotal roadway section 11 (see FIGS. 1 and 2). In this state, two finished bridge sections 3 and 4 are formed which can be transported by means of laying device 1 on vehicle 2 and which can be assembled into a long bridge as shown in FIG. 2.

To fix the movable roadway sections 11 in their upper end positions and thus to stiffen a bridge composed of two such bridge sections 3, 4, first ramp plates 33, which are articulated to movable or pivotal roadway section 11, are hinged or folded down and supported against lower chord 8. There are also second ramp plates 33' pivotally attached at the outer ends of the fixed roadway section 25 of bridge sections 3, 4 to serve as vehicle ramps when the movable bridge is in place over an obstacle.

Once frame assembly 5 has been extended, the bridge is laid in a manner analogous to a known manner by means of laying device 1 as shown in FIGS. 1–3. Lower chords 8 and the free ends of roadway sections 11 are provided with known coupling elements in order to couple bridge sections 3 and 4 together.

FIG. 3 shows the mechanism alternatively laying two short bridges which correspondingly have half the length and can be laid individually by laying device 1. Due to the lower weight of the short bridges, frame assembly 5 need not be extended for the laying process. The short bridges are erected in a simple manner by the retraction of hydraulic cylinders 12. This causes roadway sections 11 to be lowered, so that their outer longitudinal edges come to lie on side walls 9.

Figure 12:
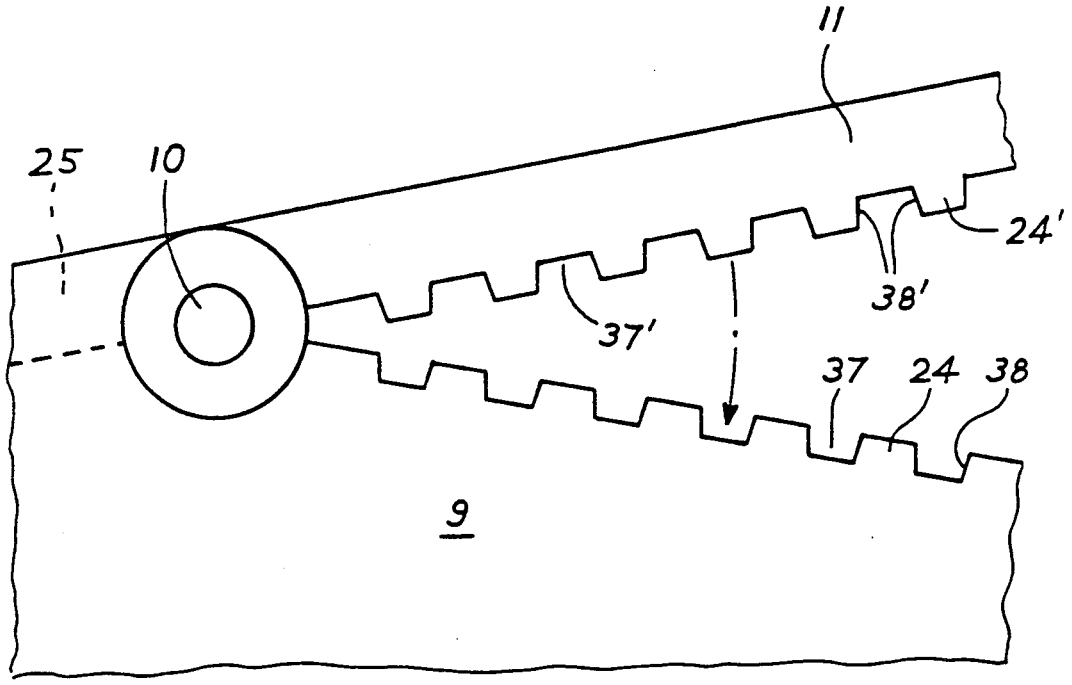

According to a further aspect of the invention, the side walls 9 and roadway sections 11 are provided with teeth 24 and 24', respectively, as indicated in FIG. 4, in order to better distribute shear forces over the length of the respective roadway section 11 and to direct forces into side walls 9. In more detail FIG. 12 shows side wall 9 of bridge section 3 with cogs or teeth 24 and tooth gaps 37 and pivotal roadway section 11 in its hinged up position with corresponding cogs or teeth 24' and tooth gaps 37'. For perfect meshing, teeth 24, 24' and gaps 37, 37' are provided with slightly inclined flanks 38, 38'.

When pivotal roadway section 11 is hinged down (see bridge section 4 in FIG. 3) flanks 38' of teeth 24' will rest on flanks 38 of teeth 24 and so longitudinal forces exerted on pivotal roadway section 11 by e.g. a braking or accelerating truck will be delivered or transmitted to side wall 9 over a considerable length.

FIG. 4 further shows coupling elements 15 for lower chords 8 and coupling elements 16 for roadway sections 11. There are also center struts 23 which connect together the two tracks and which are connected with side walls 9.

Figure 5:
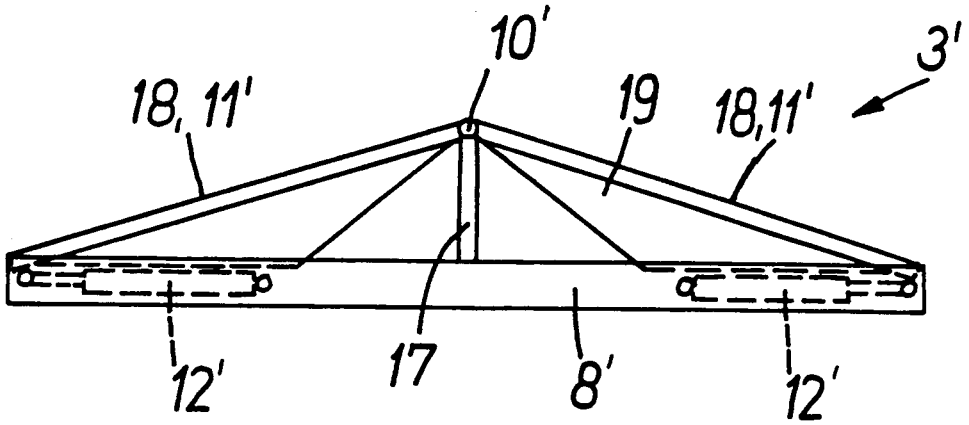
FIG. 5 is a side view of another embodiment of a bridge of the present invention.
Figure 7:
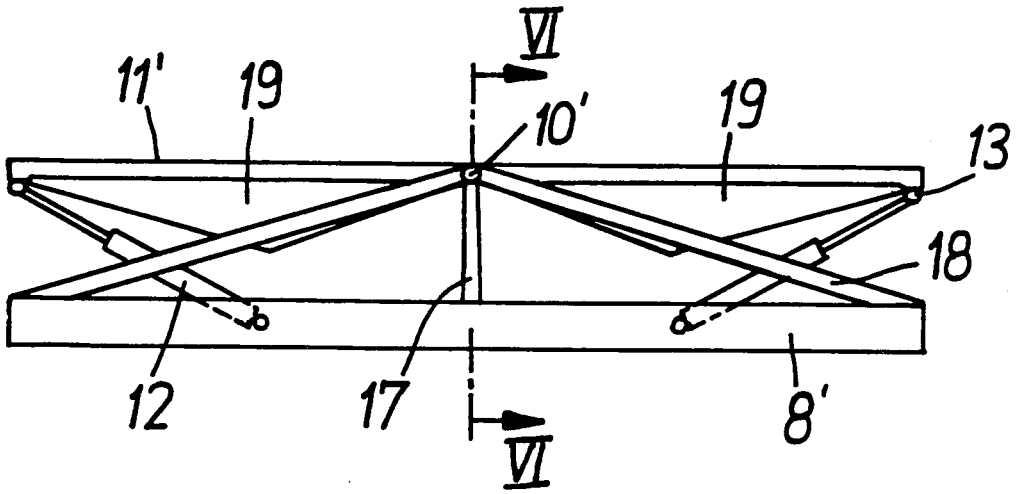
FIG. 7 shows the bridge section of FIG. 5 with the roadway section folded up.

FIG. 5 shows a bridge section 3' whose upper face is formed of two successive roadway sections 11' which are both pivotal about a hinge 10' disposed at the top of a support 17 fastened to lower chords 8'. Hinge 10' is stabilized in its position by a guy or strut 18. Roadway sections 11' are provided with reinforcing supports 19 which may simultaneously form the side wall of the roadway section and of the respective track of the roadway section. Supports 19 which may have a triangular shape may, when folded together or hinged down, lie against one another in the region of hinge 10' and their lower edges may rest on lower chords 8'. As can be seen in FIG. 7, supports 19 form braces which make roadway sections 11' resistant to bending. As shown in FIGS. 5–7, hydraulic cylinders 12' are articulated to the interior faces, with respect to the tracks, of lower chords 8'. This embodiment can be employed as a finished bridge (FIG. 5), as a bridge section having a uniform continuous height (FIG. 7), or as a ramp section if one roadway section 11' is pivoted up and the other is pivoted down.

FIG. 6 further shows that (and this also applies for the remaining embodiments) the interior of each lower chord 8' is broadened into a U-shaped rail 34. Groups of rollers 35 are arranged on laying device 1 of which only their main or center axis 36 is shown in FIGS. 1 and 3. Rollers engage in rails 34 and permit displacement or movement of bridge sections 3' and 4' on laying device 1.

Figure 8:
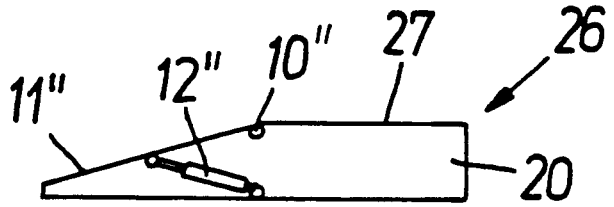
FIGS. 8 to 10 side views of further embodiments of bridge sections of the invention in three different positions.
Figure 9:
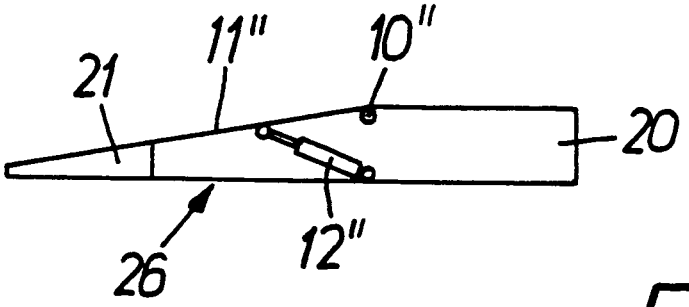
Figure 10:
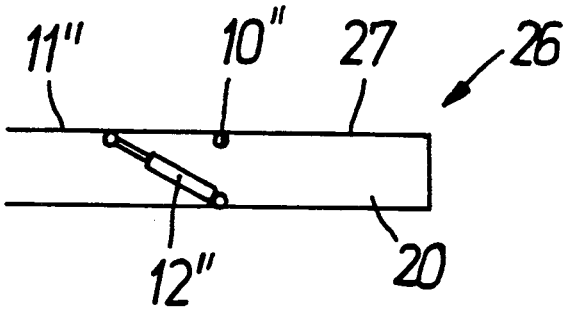

The bridge section 26 shown schematically in FIGS. 8 to 10 includes, similarly to bridge sections 3, 4 a rigid roadway section 27 and a foldable roadway section 11'', when seen toward its upper face. However, the side equipped with the rigid roadway section 27 is not configured as a wedge-shaped ramp but is of uniform height. The free end of rigid bridge section 20 including roadway section 27 may again be coupled to a bridge or ramp section. The foldable roadway section 11'' is shown folded in FIG. 8, and folded out into its upper end position in FIG. 10. FIG. 10 shows how this embodiment is used for providing a bridge of uniform height when hydraulic cylinder 12'' is extended. FIG. 9 shows the position of roadway section 11'' in a center or medium position in which it can be fixed. In this position, appropriate devices may be employed to couple an extension ramp 21. Hydraulic cylinders 12'' are articulated to roadway section 11'' in the center region of the latter so that the bridge field to be supported is effectively cut in half.

Figure 11:
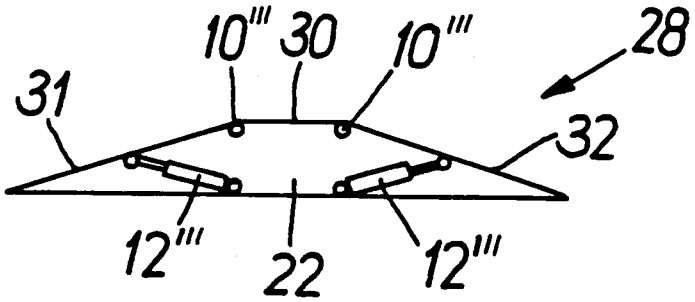
FIG. 11 is a side view of a further modified embodiment of a novel bridge section according to the invention and FIG. 12 is a partial side view of a bridge section with a toothed roadway section and a side wall to a larger scale.

Bridge section 28 in the embodiment shown in FIG. 11 includes, similar to the embodiment of FIGS. 5 to 7, two foldable roadway sections 31 and 32 which, however, are connected with one another by way of a rigid, intermediately connected center section 22 including a fixed roadway section 30, and two hinges 10''' are provided on the upper face of this bridge section 28. Similar to the embodiment of FIG. 5, this embodiment has the particular advantage that, if this bridge section is employed as a ramp, the bridge section need not be rotated by 180° in the horizontal plane before it is laid. Two hydraulic cylinders 12''' are pivotally attached to respective foldable roadway sections 31, 32 for pivoting the section about respective hinges 10'''.

The foregoing is a complete description of a preferred embodiment of the present invention. Numerous changes may be made without departing from the spirit and scope of the present invention. The invention, therefore, should be limited only by the following claims.

What is claimed is:

1. A movable bridge comprising:

a bridge section having an upper face with a roadway thereon and a hinge having a horizontal axis perpendicular to the longitudinal direction of the bridge; and a lower chord fixed to and extending along the length of said bridge section, said bridge section including an end region pivotally attached at said hinge.

2. A bridge as defined in claim 1, further comprising rail means disposed in the vicinity of said lower chord for engaging displacement means associated with a laying device.

3. A bridge as defined in claim 1, wherein said hinge is disposed in a region of the upper face of said bridge section.

4. A bridge as defined in claim 1, further comprising at least one support attached to said region.

5. A bridge as defined in claim 4, wherein said at least one support comprises at least one side wall of said end region.

6. A bridge as defined in claim 1, wherein said end region is pivotal between first and second end positions and further comprising means for fixing said end region at least in the first and second end positions.

7. A bridge as defined in claim 6, wherein said means for the fixing of said end region in at least one of said positions comprises a plurality of engaging teeth disposed on said end region and on a fixed member of said bridge section.

8. A bridge as defined in claim 1, further comprising at least one sidewall supporting said end region on said lower chord; and means for fixing said end region at least in first and second end positions, said fixing means including a plurality of engaging teeth disposed on said end region and on said at least one side wall, said plurality of engaging teeth engaging for distributing shear forces over the length of said end region and for directing forces from said end region to said lower chord.

9. A bridge as defined in claim 1, further comprising hydraulic cylinder means attached to said end region for adjustably pivoting said end region about said hinge.

10. A bridge as defined in claim 9, wherein said end region has a free end, and said hydraulic cylinder means is pivotally attached to said free end.

11. A bridge as defined in claim 1, wherein said bridge section further includes a ramp shaped end region.

12. A bridge as defined in claim 11, wherein said ramp shaped end region is pivotally attached to said bridge section.

13. A laying system for a movable bridge including: two bridges each as defined in claim 1, the end region of each said bridge being pivotal in an inclined position and presenting an upper inclined end; a laying vehicle, said two bridges being loaded on top of one another on said laying vehicle; and means for coupling together the upper inclined ends of said end regions.

* * * * *